US007507515B2

(12) United States Patent
Winters

(10) Patent No.: US 7,507,515 B2
(45) Date of Patent: Mar. 24, 2009

(54) TONER COMPOSITIONS

(75) Inventor: James A. Winters, Alfred Station, NY (US)

(73) Assignee: Xerox Corporation, Stamford, CT (US)

( * ) Notice: Subject to any disclaimer, the term of this patent is extended or adjusted under 35 U.S.C. 154(b) by 430 days.

(21) Appl. No.: 11/376,602

(22) Filed: Mar. 15, 2006

(65) Prior Publication Data

US 2007/0218395 A1 Sep. 20, 2007

(51) Int. Cl.
*G03G 9/09* (2006.01)

(52) U.S. Cl. ..... 430/111.4; 430/107.1; 430/137.1

(58) Field of Classification Search ..... 430/111.41, 430/137.1, 107.1

See application file for complete search history.

(56) References Cited

U.S. PATENT DOCUMENTS 2,874,063 A 2/1959 Greig
3,590,000 A 6/1971 Palermiti et al.
3,655,374 A 4/1972 Palermiti et al.
3,720,617 A 3/1973 Chatterji et al.
3,944,493 A 3/1976 Jadwin et al.
3,983,045 A 9/1976 Jugle et al.
4,000,087 A 12/1976 Maalouf
4,007,293 A 2/1977 Mincer et al.
4,079,014 A 3/1978 Burness et al.
4,265,990 A 5/1981 Stolka et al.
4,307,169 A 12/1981 Matkan
4,394,430 A 7/1983 Jadwin et al.
4,560,635 A 12/1985 Hoffend et al.
4,563,408 A 1/1986 Lin et al.
4,584,253 A 4/1986 Lin et al.
4,725,522 A 2/1988 Breton et al.
4,727,011 A 2/1988 Mahabadi et al.
4,766,051 A 8/1988 Breton et al.
4,797,339 A 1/1989 Maruyama et al.
4,851,318 A 7/1989 Hsieh et al.
4,855,209 A 8/1989 Martin et al.
4,858,884 A 8/1989 Harwath et al.
4,935,326 A 6/1990 Creatura et al.
4,937,166 A 6/1990 Creatura et al.
4,937,167 A * 6/1990 Moffat et al. ..... 430/137.12
4,983,488 A 1/1991 Tan et al.
4,996,127 A 2/1991 Hasegawa et al.
5,227,460 A 7/1993 Mahabadi et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,554,471 A 9/1996 Bertrand et al.

(Continued)

*Primary Examiner*—John L Goodrow
(74) *Attorney, Agent, or Firm*—Carter, DeLuca, Farrell & Schmidt, LLP

(57) ABSTRACT

A process for the preparation of color toners whereby the triboelectric charging of the various colors is optimized to permit blending of the colors to form custom colors.

20 Claims, 1 Drawing Sheet

U.S. PATENT DOCUMENTS 5,556,727 A 9/1996 Ciccarelli et al.
5,585,215 A 12/1996 Ong et al.
5,591,552 A 1/1997 Ciccarelli et al.
5,607,804 A 3/1997 Bertrand et al.
5,620,820 A 4/1997 Bertrand et al.
5,650,255 A 7/1997 Ng et al.
5,650,256 A 7/1997 Veregin et al.
5,688,626 A 11/1997 Patel et al.
5,853,943 A 12/1998 Cheng et al.
6,002,893 A 12/1999 Caruthers, Jr. et al.
6,004,714 A 12/1999 Ciccarelli et al.
6,190,815 B1 * 2/2001 Ciccarelli et al. ..... 430/110.4

* cited by examiner

TONER COMPOSITIONS

BACKGROUND

The present disclosure relates generally to toners and toner processes, and more specifically, to toner compositions having triboelectric charging properties tailored to enhance the compatibility of pigment(s) utilized therewith and combinations thereof.

Numerous processes are known for the preparation of toners, such as, for example, conventional processes wherein a resin is melt kneaded or extruded with a pigment, micronized and pulverized to provide toner particles. In addition, there are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner can also be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical Initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared In (ii), and optionally a free radical initiator, from about 0 to about 99.5 percent by weight, or from about 0 to about 97 percent by weight, of the total Initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Color toners are within the purview of those skilled in the art. In U.S. Pat. Nos. 5,556,727, 5,591,552, 5,554,471, 5,607,804, and 5,620,820, the disclosures of each of which are hereby incorporated by reference in their entirety, there is illustrated a combination of four color toners for the development of electrostatic latent images enabling the formation of a full color gamut image, wherein the four toners include a cyan toner, a magenta toner, a yellow toner, and a black toner. Each of these toners include a resin and pigment, wherein the pigment for the cyan toner is a β-copper phthalocyanine, the pigment for the magenta toner is a xanthene silicomolybdic acid salt of RHODAMINE 6G basic dye, the pigment for the yellow toner is a diazo benzidine, and the pigment for the black toner is carbon black.

In U.S. Pat. No. 5,688,626, the disclosure of which is hereby incorporated by reference in its entirety, a gamut toner aggregation process is disclosed including a process for the preparation of a combination of color toners including a cyan toner, a magenta toner, a yellow toner, and a black toner. Each of these toners include a resin and pigment, wherein the pigment is cyan, magenta, yellow and black, and each of the pigments are dispersed in a nonionic, or neutral charge surfactant.

Toner systems normally fall into two classes: two component systems, in which the developer material includes magnetic carrier granules having toner particles adhering triboelectrically thereto; and single component systems, which typically use only toner. The operating latitude of a powder xerographic development system may be determined to a great degree by the ease with which toner particles may be supplied to an electrostatic image. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Triboelectricity may be unpredictable because of the sensitivity of the materials utilized in forming toner. For example, for toners made by conventional methods, the grinding process may result in exposed pigments, which may act as charge control agents causing the different color toners to behave different with respect to triboelectric properties. This difference, in turn, may lead to a high degree of incompatibility between the primary color toners which may be used to form the foundation of new colors by dry blending. The sensitivity of the toner materials may also cause difficulties in identifying a triboelectrically compatible set of color toners that can be blended for custom colors.

To enable "offset" print quality with powder-based electrophotographic development systems, small toner particles (about 5 micron diameter) may be desired. Although the functionality of small, triboelectrically charged toner has been demonstrated, concerns remain regarding the long-term stability and reliability of such systems.

Development systems which use triboelectricity to charge toner, whether they be two component (toner and carrier) or single component (toner only), tend to exhibit nonuniform distribution of charges on the surfaces of the toner particles. This nonuniform charge distribution may result in high electrostatic adhesion because of localized high surface charge densities on the particles. For example, the electrostatic adhesion forces for tribo-charged toner, which are dominated by charged regions on the particle at or near its points of contact with a surface, do not rapidly decrease with decreasing size.

This so-called "charge patch" effect makes smaller, triboelectric charged particles much more difficult to develop and control. Toner adhesion, especially in the development step, can limit performance by hindering toner release.

Moreover, if one attempts to blend different color parent toners under the same blend conditions, the charging properties of the colors may be dominated by pigment effects leading to different charging, and therefore incompatibility. Often, the charging effects caused by pigments are compensated by additional charge control agents which cause the different colors to diverge in additive formulations, which also leads to incompatibility for dry blending.

Improved methods for producing toner, which increase the compatibility of different color toners thereby reducing the cost associated with such toners, and which are capable of utilizing existing processing equipment and machinery, remain desirable.

SUMMARY

The present disclosure provides processes for forming toner compositions and toners formed thereby. In embodiments, the present disclosure includes processes which include contacting a resin with a first colorant to form a first toner, applying a triboelectric charge to said first toner by admixing the first toner at a first rate, contacting a resin with a second colorant to form a second toner; and applying a triboelectric charge to said second toner by admixing the second toner at a second rate, wherein the first rate and the second rate are the same, and the triboelectric charge applied to said second toner is the same as the triboelectric charge applied to said first toner.

In embodiments, the present disclosure provides processes which include contacting a resin with a cyan colorant to form a cyan toner, applying a triboelectric charge to said cyan toner by admixing the cyan toner at a first rate, contacting a resin with a yellow colorant to form a yellow toner, applying a triboelectric charge to said yellow toner by admixing the yellow toner at a second rate, contacting a resin with a magenta colorant to form a magenta toner, applying a triboelectric charge to said magenta toner by admixing the magenta toner at a third rate, contacting a resin with a carbon black colorant to form a carbon black toner, and applying a triboelectric charge to said carbon black toner by admixing the carbon black toner at a fourth rate, wherein the first rate, the second rate, the third rate and the fourth rate are the same and the triboelectric charge of the cyan toner, the yellow toner, the magenta toner and the carbon black toner are the same.

The present disclosure also provides for compositions which may include a first toner including a first resin in combination with a first colorant and possessing a triboelectric charge, and a second toner including a second resin in combination with a second colorant possessing the same triboelectric charge as the first toner.

BRIEF DESCRIPTION OF THE DRAWINGS

Various embodiments of the present disclosure will be described herein below with reference to the figures wherein.

DETAILED DESCRIPTION

Due to the large difference in pigment charging properties, it may be difficult to combine color toners in a dry blend format to form new colors. The present disclosure provides processes by which the electrical charge of toners, including conventional toners and emulsion aggregation toners, may be adjusted to improve their ability to be combined to create new toner colors for custom color on demand.

The present disclosure utilizes a blending process to impart charging characteristics to the toner particles of the separate colors before mixing. If the triboelectric charge and triboelectric charging rates of the different color toners are the same, then the toners can be combined together to form new colors. The process imparts a color blind nature to toner particles, for example, green toners which cannot be distinguished from red toners, or from any other color toners. If the triboelectric charge and triboelectric charging rates of the different color toners are the same, then the toners can be combined together to form new colors. The blending process of the present disclosure can thus be used to obtain toners using different pigments having similar charging characteristics, while using the same additive package.

Figure 1:
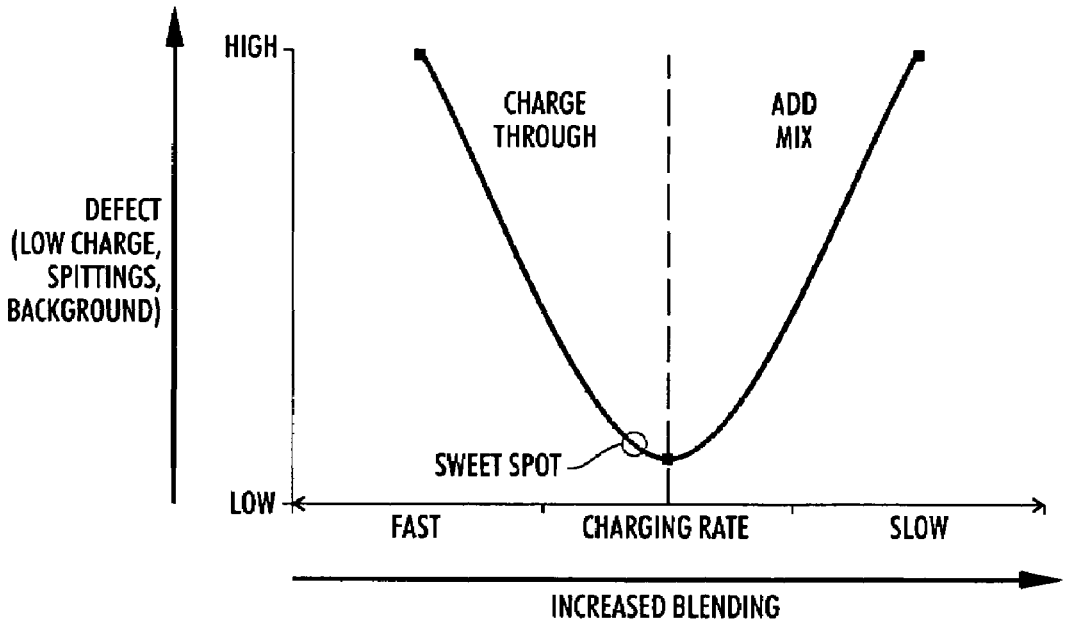
FIG. 1 is a graph depicting the choice of blend parameters for two color toners utilizing different pigments such that the charging rate of the two materials may be equivalent.

In accordance with the present disclosure, for toners using identical additive packages and resin base, the blending process can be used to either slow or speed up the charging rate of toners. In embodiments, the rate of charging of a toner may include, for example, the intensity of blending multiplied by the length of time blending occurs. The intensity of blending may include, in embodiments, the revolutions per minute (rpm) a blender is operated at. For example, green pigments may be fast charging materials whereas magenta pigments may be slow charging materials. Utilizing processes of the present disclosure, blending parameters, especially the intensity of blending and the length of time of blending, may be utilized to slow down the charging rate of the green toner and speed up the charging rate of the magenta material so that the two color toners have the same charging rate. The net result is a green and magenta toner with identical resin base and identical additive packages, but with differing blend parameters. Despite the different pigments, the blend parameters are chosen such that the charging rate of the two materials may be equivalent. FIG. 1 illustrates this concept.

Following the processes of the present disclosure, it becomes possible to charge conventional color toners with a common resin base and common additive package in what is depicted as a "sweet spot" on FIG. 1. These toners are by design compatible with each other because of their commonalty of charging as well as formulation. Therefore, the toners can be combined together to form new colors. The mixing process by which the colors are combined may be both a low energy and low intensity process so that further functionality is not imparted to the toners due to further blending. This mixing process can include, but is not limited to, tumble blending, blending with Henschel mixers (sometimes referred to as Henschel blending), agitation using a paint style mixer, and the like. Effective mixing can also be accomplished within the toner cartridge/bottle by shaking by hand.

Once the primary conventional toners are established, any combinations of them can be combined to create new quick custom colors.

In embodiments, toners of the present disclosure may have desired triboelectric properties applied to them utilizing various devices, including blenders, such as a Henschel 600 L, Henschel 75 L, Henschel 10 L, and the like. While the exact blending parameters will vary depending upon the composition of the toner utilized, that is, the resin, pigment, any additives, and the like, in embodiments, a green toner may be blended at a speed from about 1 rpm to about 5000 rpm, in embodiments about 1000 rpm to about 1200 rpm, for a period of time from about 10 seconds to about 30 minutes, in embodiments from about 2 minutes to about 6 minutes; a blue toner may be blended at a speed from about 1 rpm to about 5000 rpm, in embodiments about 900 rpm to about 1100 rpm, for a period of time from about 10 seconds to about 30 minutes, in embodiments from about 2 minutes to about 6 minutes; a red toner may be blended at a speed from about 1 rpm to about 5000 rpm, in embodiments about 600 rpm to about 900 rpm, for a period of time from about 10 seconds to about 30 minutes, in embodiments from about 4 minutes to about 8 minutes. Similarly, additional primary colored toners may be produced to increase the achievable gamut space. Examples of such additional colors which may be utilized include magenta, cyan, yellow, white and/or clear, black, and the like.

The result of the blending process of the present disclosure is that the different color toners may have equivalent triboelectric charging, for example, mean triboelectric values, and a similar or same admix rate, that is, the rate of charging of the different color toners may be the same. The equivalent triboelectric charging of the different color toners allows for the dry blending of different color toners to form new colors. Suitable triboelectric charging of an individual toner may vary depending upon its composition, that is, the pigment utilized in the toner, the resin, any additives, and the like. In embodiments, toners of the present disclosure may have a triboelectric charge of from about −100 μC/gram to about 100 μC/gram, in embodiments from about −8 μC/gram to about −35 μC/gram.

Illustrative examples of specific latex resins, polymer or polymers that can be utilized to form toners in accordance with the present disclosure include styrene acrylates, styrene butadienes, styrene methacrylates, and more specifically, poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid). In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol may also be used.

In embodiments, a poly(styrene-butyl acrylate) may be utilized as the latex.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

The toner compositions can be prepared by any suitable method. For example, the components of the toner particles can be mixed in a ball mill, to which steel beads for agitation may be added in an amount of from about 3 times to about 7 times the weight of the toner, in embodiments from about 4 times to about 6 times the weight of the toner. The ball mill can be operated at a speed of from about 100 to about 140 feet per minute, in embodiments from about 110 to about 130 feet per minute for a time from about 10 minutes to about 60 minutes, in embodiments from about 20 minutes to about 40 minutes, after which time the steel beads may be removed.

Another method, known as spray drying, entails dissolving the appropriate polymer or resin in an organic solvent such as toluene or chloroform, or a suitable solvent mixture. The optional colorant may also be added to the solvent. Vigorous agitation, such as that obtained by ball milling processes, assists in assuring good dispersion of the components. The solution is then pumped through an atomizing nozzle while using an inert gas, such as nitrogen, as the atomizing agent. The solvent evaporates during atomization, resulting in toner particles which are then attrited and classified by particle size. Particle diameter of the resulting toner varies, depending on the size of the nozzle, and generally varies from about 0.1 to about 100 microns.

Another suitable process which may be utilized is the Banbury method, a batch process wherein the toner ingredients may be pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process which may be utilized, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Encapsulated toners can also be utilized. For example, encapsulated toners can be prepared by an interfacial/free-radical polymerization process in which the shell formation and the core formation are controlled independently. The core materials selected for the toner composition are blended together, followed by encapsulation of these core materials within a polymeric material, followed by core monomer polymerization. The encapsulation process generally takes place by means of an interfacial polymerization reaction, and the optional core monomer polymerization process generally occurs by means of a free radical reaction. Processes for preparing encapsulated toners by these processes are disclosed in, for example, U.S. Pat. No. 4,000,087, U.S. Pat. No. 4,307,169, U.S. Pat. No. 4,725,522, U.S. Pat. No. 4,727,011, U.S. Pat. No. 4,766,051, U.S. Pat. No. 4,851,318, U.S. Pat. No. 4,855,209, and U.S. Pat. No. 4,937,167, the disclosures of each of which are totally incorporated by reference herein. In embodiments, the oxidation/reduction polymerization may be performed at a temperature from about 20° C. to about 40° C. after the interfacial/free-radical polymerization process is complete, thereby forming an intrinsically conductive polymeric shell on the particle surfaces.

Toners of the present disclosure can also be prepared by an emulsion aggregation process. Emulsion aggregation involves aggregation of both submicron latex and pigment particles into toner size particles, where the growth in particle size is, for example, from submicron to about 3 to about 10 microns. Pigments added to such toner particles thus are generally combined with the same toner size. However, as the pigments utilized may not be uniform in size, it may be easier to obtain higher loadings with some pigments having a smaller size.

For toner prepared by an emulsion aggregation process, in embodiments the latex may be prepared in an aqueous phase containing a surfactant or co-surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates, sodium dodecylsulfate (SDS), sodium dodecylbenzene sulfonate, sodium dodecyinaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, and the like, and mixtures thereof. In embodiments a suitable cationic surfactant includes SANISOL B-50 available from Kao Corp., which is primarily a benzyl dimethyl alkonium chloride.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

The choice of particular surfactants or combinations thereof as well as the amounts of each to be used are within the purview of those skilled in the art.

In embodiments initiators may be added for formation of the latex. Examples of initiators include water soluble initiators, such as ammonium persulfate, sodium persulfate and potassium persulfates, and organic soluble initiators including organic peroxides and azo compounds including Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent, and in embodiments of from about 0.2 to about 5 weight percent of the monomers.

In embodiments chain transfer agents may be utilized including dodecane thiol, octane thiol, carbon tetrabromide, mixtures thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

In some embodiments a pH titration agent may be added to control the rate of the emulsion aggregation process. The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

In embodiments, a wax may also be added to the latex, which may enable toner cohesion and inhibit the formation of toner aggregates. In embodiments, the wax may be in a dispersion. Wax dispersions suitable for use in toners of the present disclosure include, for example, submicron wax particles having a size of from about 50 to about 500 nanometers, in embodiments of from about 100 to about 400 nanometers in volume average diameter. The wax particles may be suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion may include any suitable wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL® 74, 89, 130, 537, and 538, all available from Johnson Diversey, Inc, or chlorinated polypropylenes and polyethylenes commercially available from Allied Chemical and Petrolite Corporation and Johnson Diversey, Inc. In embodiments, the wax may be a polyethylene wax functionalized with ester groups.

The wax may be present in an amount of from about 1 to about 30 percent by weight, and in embodiments from about 2 to about 20 percent by weight of the toner.

In the emulsion aggregation process, the reactants may be added to a suitable reactor, such as a mixing vessel. The appropriate amount of at least two monomers, stabilizer, surfactant(s), initiator, if any, chain transfer agent, if any, and wax, if any, and the like may be combined in the reactor and the emulsion aggregation process is allowed to begin. Reaction conditions selected for effecting the emulsion polymerization include temperatures ranging, for example, from about 45° C. to about 120° C., in embodiments about 60° C. to about 90° C. In embodiments the polymerization may occur at elevated temperatures within 10 percent of the melting point of any wax, for example from about 60° C. to about 85° C., in embodiments from about 65° C. to about 80° C. to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter as determined, for example, by a Brookhaven nanosize particle analyzer.

After formation of the latex particles, the latex particles may be utilized to form a toner. In embodiments, the toners are an emulsion aggregation type toner that are prepared by the aggregation and fusion of the latex particles of the present disclosure with a colorant, and one or more additives such as surfactants, coagulants, waxes, surface additives, and optionally mixtures thereof.

The latex particles may then be added to a colorant dispersion in the emulsion aggregation process. The colorant dispersion includes, for example, submicron colorant particles in a size range of, for example, from about 50 to about 500 nanometers and, in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and is from about 1 to about 25 percent by weight, and in embodiments from about 4 to about 15 percent by weight of the colorant.

The resultant blend of latex, optionally in a dispersion, and colorant dispersion may be stirred and heated to a temperature of from about 45° C. to about 65° C., in embodiments of from about 48° C. to about 63° C., resulting in toner aggregates of from about 3 microns to about 15 microns in volume average diameter, and in embodiments of from about 5 microns to about 8 microns in volume average diameter.

In embodiments, a coagulant may be added during or prior to aggregating the latex and the aqueous colorant dispersion. The coagulant may be added over a period of time from about 1 to about 20 minutes, in embodiments from about 1.25 to about 8 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 2 percent by weight of the toner, and in embodiments from about 0.1 to about 1.5 percent by weight of the toner.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the toner formulation processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

The toner may also include charge additives in effective amounts of, for example, from about 0.1 to about 10 weight percent, in embodiments from about 0.5 to about 7 weight percent. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, mixtures thereof, and the like.

Once the desired final size of the toner particles is achieved with a volume average diameter of from about 5 microns to about 7 microns, and in embodiments of from about 5.3 microns to about 6.5 microns, the pH of the mixture may be adjusted with a base to a value of from about 5 to about 7, and in embodiments from about 6 to about 6.8. The base may include any suitable base such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

The mixture is subsequently coalesced. Coalescing may include stirring and heating at a temperature of from about 90° C. to about 99° C., for a period of from about 0.5 to about 12 hours, and in embodiments from about 2 to about 6 hours. Coalescing may be accelerated by additional stirring.

The pH of the mixture is then lowered to from about 3.5 to about 6 and in embodiments, to from about 3.7 to about 5.5 with, for example, an acid to coalesce the toner aggregates. Suitable acids include, for example, nitric acid, sulfuric acid, hydrochloric acid, citric acid or acetic acid. The amount of acid added may be from about 4 to about 30 percent by weight of the mixture, and in embodiments from about 5 to about 15 percent by weight of the mixture.

The mixture is cooled, washed and dried. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters.

The toner slurry may then be washed. Washing may be carried out at a pH of from about 7 to about 12, and in embodiments at a pH of from about 9 to about 11. The washing is at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying is typically carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

In embodiments, each of the pigments may be present in toners utilized to form a color toner of the present disclosure in an amount from about 2 to about 25 weight percent based on the weight percent of resin and pigment, wherein each of the pigments may be present in an amount of from about 2 to about 15 weight percent based on the weight percent of resin and pigment.

In embodiments a four color system may be utilized as the primary color toners, which may then be blended in accordance with the present disclosure to enable a wide custom color gamut.

The combination, set, or gamut of four separate color toners may include a cyan toner, a magenta toner, a yellow toner, and a black toner. The toners include the individual pigment, latex having desired particle size and any optional additives described above. In embodiments each of the cyan, magenta, yellow and black pigments may possess a diameter particle size or agglomerate diameter size of from about 0.01 microns to about 3 microns, and wherein each of said cyan, magenta, and yellow pigments may be of a particle diameter size or agglomerate diameter size of from about 0.01 microns to about 0.3 microns, and the black pigment is of a particle diameter size of from about 0.001 microns to about 0.1 microns.

An emulsion aggregation toner of the present disclosure may have particles with a circularity of from about 0.93 to about 0.99, and in embodiments of from about 0.94 to about 0.98. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

Further optional additives which may be combined with the toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Utilizing the processes of the present discourse, one can use conventional toners in developing custom colors, as conventional toners are well established and can be quick to market. Similarly, in embodiments, the processes of the present disclosure may be used to develop custom colors for toners prepared by emulsion aggregation processes.

Toner in accordance with the present disclosure can be used in a variety of imaging devices including printers, copy machines, and the like. The toners may be used as part of an imaging process which includes the generation of an electrostatic image on a photoconductive imaging member followed by the development thereof with a combination, set, or gamut of toners, and wherein the toners may include an individual cyan toner, magenta toner, yellow toner, green toner, blue toner, red toner, and black toner.

Custom color blends of toner can be made in an offline (paint shop) batch process; one can also arrange to have a set of primary color toners continuously feeding a sump of toner within (in-situ) the printer, which enables a dial-a-color system provided that an in-situ toner waste system is provided for color switching. In embodiments, a particular custom color can be produced by offline equipment that blends a number of toners selected from a set of primary color toners (plus transparent and black toners) that enable a wide custom color gamut. In embodiments, a xerographic machine may utilize a process for selecting proportional amounts of the primary toners from a dispenser therein for in-situ addition to an SCD housing. An example of such a machine and process is set forth in U.S Pat. No. 6,365,318, the disclosure of which is hereby incorporated by reference in its entirety. The color may be controlled by the relative weights of the primary toners. In embodiments, the xerographic apparatus may dispense toner into a toner bottle for feeding toner to an SCD housing in the machine, or dispense toner directly to the sump of an SCD system on a periodic basis according to the amount needed based on the run length and area coverage. The dispensed toners are tumbled/agitated to blend the primary toners prior to use. In addition to the nine primary color toners for formulating a wide color gamut, one can also use metallic toners (which tend to be conducting and therefore compatible with the SCD process) which are desired for greeting, invitation, and name card applications.

The toners may also be used as part of an imaging process which includes the generation of an electrostatic image on a photoconductive imaging member followed by the development thereof with a combination, set, or gamut of toners of the present disclosure. The process includes transferring the developed image to a substrate, and fixing the image thereto.

The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidene fluoride, mixtures of resins not in close proximity in the triboelectric series such as polyvinylidene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging methods are also envisioned with the toners disclosed herein. Such methods include, for example, some of the above patents mentioned above and U.S. Pat. Nos. 4,265,990, 4,858,884, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A green colored toner was prepared as follows. A partially cross linked polyester resin obtained from the reaction of bisphenol A and propylene carbonate, followed by the reaction of the resulting product with fumaric acid, was melt mixed with about 9.3% by weight of Pigment Green 36. The resulting material, referred to herein as green extrudate, was micronized and particle size classified into green parent toner. About 100 parts of the resulting green parent toner was surface treated with about 2.1 parts treated silica as described in U.S. Pat. No. 6,190,815, the disclosure of which is hereby incorporated by reference in its entirety, in combination with about 0.75 parts titanium dioxide ($TiO_2$), and about 0.5 parts calcium stearate (CaSt) by blending in a Henschel 75 L blender at about 1740 rpm for about 5.6 minutes. The resulting green toner had a particle size of about 12 microns, and a triboelectric charge of about 20 micro-Coulombs/gram.

Example 2

A red colored toner was similarly prepared following the general procedure described above in Example 1 for preparation of the green toner. A partially cross linked polyester resin obtained from the reaction of bisphenol A and propylene carbonate, followed by the reaction of the resulting product with fumaric acid, was melt mixed with about 8.31% by weight of Pigment Red 48:1. The resulting material, referred to herein as a red extrudate, was micronized and particle size classified into red parent toner. About 100 parts of the resulting red parent toner was surface treated with about 2.1 parts treated silica as described in U.S. Pat. No. 6,190,815, in combination with about 0.75 parts $TiO_2$, and about 0.5 parts CaSt by blending in a Henschel 75 L blender at about 1340 rpm for about 4 minutes. The resulting red toner had a particle size of about 12 microns and a triboelectric charge of about 20 micro-Coulombs/gram.

Example 3

The green toner of Example 1 was combined with the red toner of Example 2 in accordance with the present disclosure. About 1.5 pounds of the green toner of Example 1 was combined with about 1.5 pounds of the red toner of Example 2 to form a new color (brown). The toners were combined using a tumble blender for about 5 minutes.

The color stability test was conducted as follows. Briefly, the brown toner blend was placed in a DT180HLC printer from Xerox Corp., and copies were made using the brown toner blend. About 25,000 copies were made, with system level color stability being tracked by examining the copies at about 5,000 about 10,000, about 15,000, about 20,000 and about 25,000 total copies. System level color stability was determined by measuring the color in CIELAB coordinates of the prints at each of the print increments described above. Using delta E 2000, the color difference was calculated referenced to the first print out.

Figure 2:
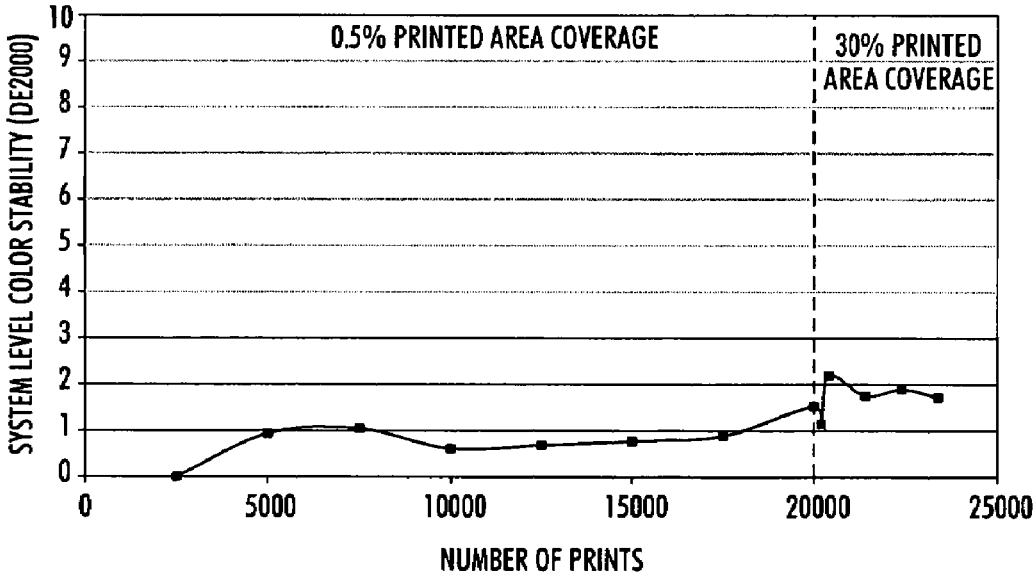
FIG. 2 is a graph depicting the results of color stability tests of toner produced in accordance with the present disclosure.

The results of the above color stability test are set forth in FIG. 2. As can be seen in FIG. 2, the green and red toners utilized to form the brown toner blend possessed excellent compatibility and possessed excellent system level color stability, that is, the brown toner was color stable and possessed a minimum level of color separation during the about 25,000 prints which included the most stringent stresses of area coverage, i.e., long run printing at very low area coverage followed by high area coverage.

Thus, the above Examples and print tests described therein indicate the successful tumble blending of a conventional green toner with a conventional red toner to form a brown toner in accordance with the present disclosure.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process comprising:

contacting a resin with a first colorant to form a first toner;

applying a triboelectric charge to said first toner by admixing the first toner at a first rate;

contacting a resin with a second colorant to form a second toner; and applying a triboelectric charge to said second toner by admixing the second toner at a second rate, wherein the first rate and the second rate are the same, and the triboelectric charge applied to said second toner is the same as the triboelectric charge applied to said first toner.

2. The process of claim 1, further comprising contacting the first toner with the second toner to form a custom color toner.

3. The process of claim 1, wherein the resin used to form the first toner and the second toner is the same or different and is selected from the group consisting of styrenes, acrylates, methacrylates, butadienes, isoprenes, acrylic acids, methacrylic acids, acrylonitriles, and mixtures thereof.

4. The process of claim 1, wherein the resin used to form the first toner and the second toner is the same or different and is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile acrylic acid), and poly(acrylonitrile-butyl acrylate-acrylic acid).

5. The process of claim 1, wherein the first colorant and the second colorant are different and are selected from the group consisting of pigments, dyes, mixtures of pigments and dyes, mixtures of pigments, and mixtures of dyes.

6. The process of claim 1, wherein the first colorant and the second colorant are different and are selected from the group consisting of carbon black, cyan, yellow, magenta, red, orange, brown, green, blue, violet and mixtures thereof.

7. The process of claim 1, wherein the triboelectric charge of the first toner and the second toner is from about −100 μC/gram to about 100 μC/gram.

8. The process of claim 1, further comprising contacting the first toner and the second toner with one or more components selected from the group consisting of surfactants, coagulants, waxes, surface additives, and optionally mixtures thereof.

9. The process of claim 1, further comprising contacting a resin with at least one different colorant to form at least one different color toner and applying a triboelectric charge to said at least one different color toner that is the same as the triboelectric charge applied to said first toner and said second toner.

10. The process of claim 9, wherein the process includes contacting a resin with two different colorants to form two different color toners and wherein the triboelectric charge applied to each toner is the same.

11. A process comprising:

contacting a resin with a cyan colorant to form a cyan toner;

applying a triboelectric charge to said cyan toner by admixing the cyan toner at a first rate;

contacting a resin with a yellow colorant to form a yellow toner;

applying a triboelectric charge to said yellow toner by admixing the yellow toner at a second rate;

contacting a resin with a magenta colorant to form a magenta toner;

applying a triboelectric charge to said magenta toner by admixing the magenta toner at a third rate;

contacting a resin with a carbon black colorant to form a carbon black toner; and applying a triboelectric charge to said carbon black toner by admixing the carbon black toner at a fourth rate, wherein the first rate, the second rate, the third rate and the fourth rate are the same and the triboelectric charge of the cyan toner, the yellow toner, the magenta toner and the carbon black toner are the same.

12. The process of claim 11, wherein the resin utilized to form the cyan toner, the yellow toner, the magenta toner, and the carbon black toner is the same or different and is selected from the group consisting of styrenes, acrylates, methacrylates, butadienes, isoprenes, acrylic acids, methacrylic acids, acrylonitriles, and mixtures thereof.

13. The process of claim 11, wherein the resin utilized to form the cyan toner, the yellow toner, the magenta toner, and the carbon black toner is the same or different and is selected from the group consisting of poly(styrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid).

14. The process of claim 11, further comprising contacting the cyan toner, and optionally the yellow toner, the magenta toner, and the carbon black toner, with one or more components selected from the group consisting of surfactants, coagulants, waxes, surface additives, and optionally mixtures thereof.

15. The process of claim 11, further comprising forming a custom color toner by contacting the cyan toner, the yellow toner, the magenta toner, and the carbon black toner, in any combination, to form the custom color toner.

16. The process of claim 11, wherein the triboelectric charge of the cyan toner, the yellow toner, the magenta toner, and the carbon black toner is from about −100 μC/gram to about 100 μC/gram.

17. A composition comprising:

a first toner comprising a first resin in combination with a first colorant and possessing a triboelectric charge obtained by admixing the first resin and first colorant at a first rate;

a second toner comprising a second resin in combination with a second colorant possessing the same triboelectric charge as the first toner, the triboelectric charge of the second toner obtained by admixing the first resin and first colorant at a second rate.

18. The composition of claim 17, wherein the resin used to make the first toner and the second toner is the same or different and is selected from the group consisting of styrenes, acrylates, methacrylates, butadienes, isoprenes, acrylic acids, methacrylic acids, acrylonitriles, and mixtures thereof, the first colorant and the second colorant are different and are selected from the group consisting of pigments, dyes, mixtures of pigments and dyes, mixtures of pigments, and mixtures of dyes, and the first toner and the second toner optionally include one or more components selected from the group consisting of surfactants, coagulants, waxes, surface additives, and optionally mixtures thereof.

19. The composition of claim 17, further comprising at least one additional toner comprising at least one resin in combination with at least one additional pigment, wherein the at least one additional toner has the same triboelectric charge as the first toner and the second toner.

20. A color toner comprising the composition of claim 17.

* * * * *